US008348020B2

(12) United States Patent
Ohya et al.

(10) Patent No.: US 8,348,020 B2
(45) Date of Patent: Jan. 8, 2013

(54) ELEVATOR CONTROL DEVICE WITH CARRIER FREQUENCY SWITCH CIRCUIT

(75) Inventors: Hiroaki Ohya, Fukuoka (JP); Masashiro Tanaka, Fukuoka (JP); Yoichi Yamamoto, Fukuoka (JP)

(73) Assignee: Kabushiki Kaisha Yaskawa Denki, Kitakyushu-Shi (JP)

( * ) Notice: Subject to any disclaimer, the term of this patent is extended or adjusted under 35 U.S.C. 154(b) by 308 days.

(21) Appl. No.: 12/877,110

(22) Filed: Sep. 8, 2010

(65) Prior Publication Data

US 2011/0056771 A1 Mar. 10, 2011

(30) Foreign Application Priority Data

Sep. 8, 2009 (JP) ..... 2009-206603

(51) Int. Cl.
*B66B 1/06* (2006.01)

(52) U.S. Cl. ..... 187/289; 318/432; 318/811

(58) Field of Classification Search ..... 187/289, 187/290, 293, 296, 297, 391–393; 318/700, 318/716, 729, 799–815
See application file for complete search history.

(56) References Cited

U.S. PATENT DOCUMENTS

| | | | | |
|---|---|---|---|---|
| 4,628,475 | A * | 12/1986 | Azusawa et al. | 708/845 |
| 6,819,077 | B1 * | 11/2004 | Seibel et al. | 318/801 |
| 7,049,779 | B2 * | 5/2006 | Chen et al. | 318/400.09 |
| 7,061,195 | B2 * | 6/2006 | Ho et al. | 318/438 |
| 7,148,651 | B2 * | 12/2006 | Tobari et al. | 318/802 |
| 7,176,645 | B2 * | 2/2007 | Shimada et al. | 318/432 |
| 7,663,329 | B2 * | 2/2010 | Muta | 318/432 |
| 7,782,005 | B2 * | 8/2010 | Shin et al. | 318/632 |
| 7,872,435 | B2 * | 1/2011 | Imai et al. | 318/599 |
| 7,923,961 | B2 * | 4/2011 | Takamatsu et al. | 318/811 |
| 2009/0184681 | A1 * | 7/2009 | Kuno | 320/128 |
| 2011/0204831 | A1 * | 8/2011 | Iwaji et al. | 318/244 |
| 2011/0266992 | A1 * | 11/2011 | Nishiguchi et al. | 318/807 |

FOREIGN PATENT DOCUMENTS

| | | |
|---|---|---|
| JP | 63-225083 | 9/1988 |
| JP | 06-009165 | 1/1994 |
| JP | 2005-162376 | 6/2005 |

* cited by examiner

*Primary Examiner* — Anthony Salata

(74) *Attorney, Agent, or Firm* — Ditthavong Mori & Steiner, P.C.

(57) ABSTRACT

An elevator control device includes a vector controller that calculates a voltage command required for driving an elevator cage, a carrier frequency switch circuit that outputs a carrier frequency signal, and a power converter that performs PWM control based on the voltage command and the carrier frequency signal, generates an AC power and supplies the AC power to an AC motor. The carrier frequency switch circuit changes the carrier frequency signal when a torque command for driving the AC motor reaches a torque limit value. Thus, it is possible to continuously operate an elevator without causing damage to a switching element of the power converter.

6 Claims, 7 Drawing Sheets

ELEVATOR CONTROL DEVICE WITH CARRIER FREQUENCY SWITCH CIRCUIT

CROSS-REFERENCE TO RELATED APPLICATION

The present application claims priority under 35 U.S.C. §119 to Japanese Patent Application No. 2009-206603, filed on Sep. 8, 2009. The contents of the application are incorporated herein by reference in their entirety.

BACKGROUND OF THE INVENTION

1. Field of the Invention

The present invention relates to an elevator control device.

2. Description of Related Art

A related elevator control device adopts such a system that an inverter device is used for driving an alternating-current (AC) motor (hereinafter, also simply referred to as a motor). Herein, the inverter device subjects a switching element, such as a power transistor or an IGBT (Insulated Gate Bipolar Transistor), to PWM (Pulse Width Modulation) control. It is assumed herein that an inverter device is selected from a viewpoint of generating a torque required in normal operation of an elevator. In such a case, the selected inverter device becomes short of capacitance in overloaded test operation to be carried out at the time of completion or performance evaluation of the elevator. When being selected in consideration of such a test, an inverter device disadvantageously increases in cost and size.

JP 06-009165 A discloses a technique for making a carrier frequency variable in accordance with an operating speed of an inverter device. Moreover, JP 2005-162376 A discloses a technique for switching a coil of a motor to be driven and decreasing a carrier frequency. A decreased carrier frequency of an inverter device allows suppression of a loss caused to a switching element. Therefore, it becomes possible to produce higher torque and larger electric current in an inverter device with invariable capacitance.

SUMMARY OF THE INVENTION

According to one aspect of the present invention, an elevator control device includes a motor controller that calculates a voltage command required for driving an elevator cage, a carrier frequency switch circuit that outputs a carrier frequency signal, and a power converter that performs PWM control based on the voltage command and the carrier frequency signal and supplies an AC power to an AC motor. Herein, the elevator control device changes the carrier frequency signal in a case where a torque command for driving the AC motor or an output current reaches a limit value during operation of the elevator, or at a timing obtained previously prior to operation of the elevator.

According to another aspect of the present invention, the elevator control device monitors overload information about the timing obtained previously prior to operation of the elevator and the timing that the output current reaches the limit value during operation of the elevator.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
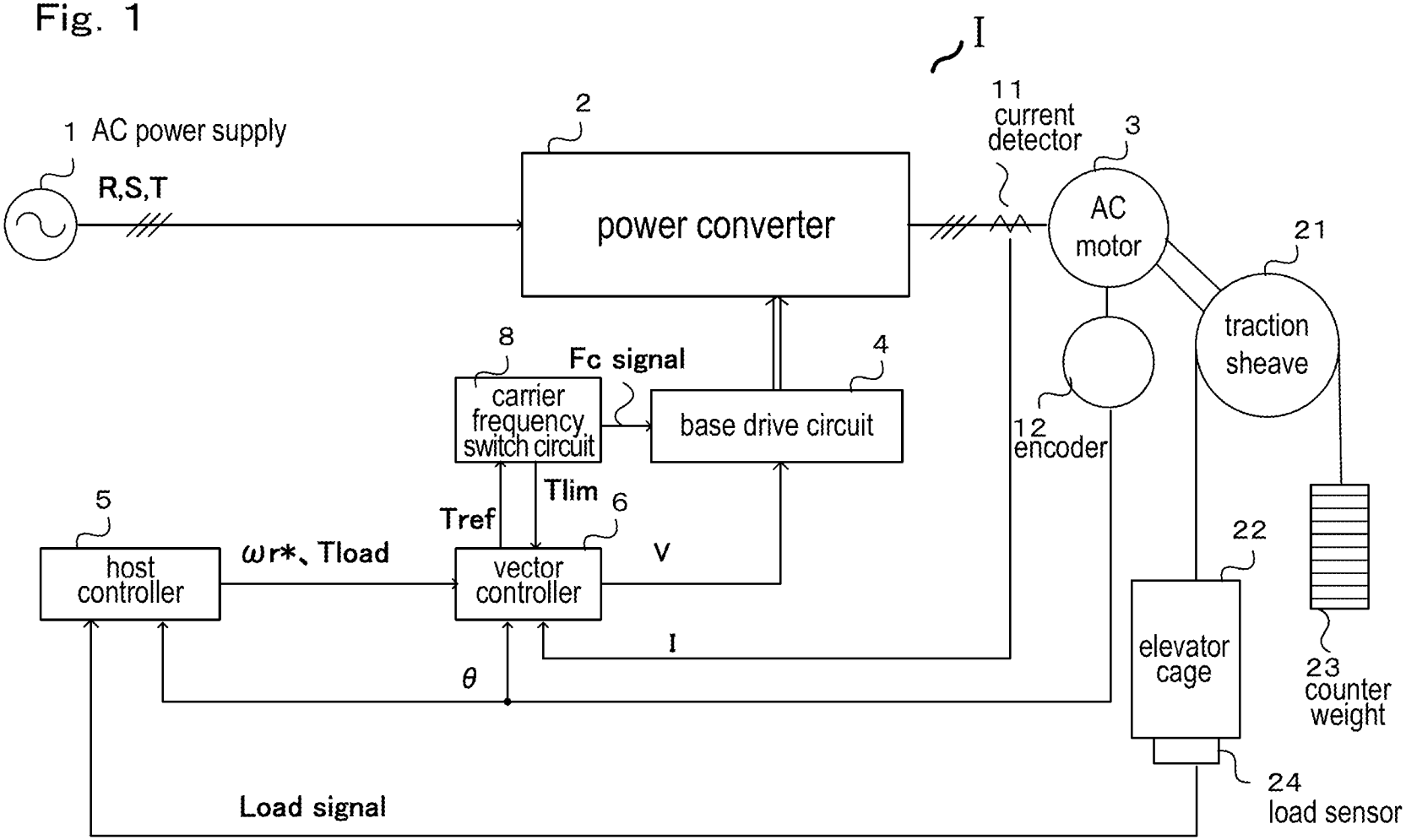
FIG. 1 shows a block diagram of a configuration of an elevator control device I according to a first embodiment of the present invention.

Embodiments will now be described with reference to the accompanying drawings, wherein like reference numerals designate corresponding or identical elements throughout the various drawings.

FIG. 1 shows a block diagram of an elevator control device I according to a first embodiment of the present invention.

The elevator control device I includes an AC power supply 1, a power converter 2, an AC motor 3, a base drive circuit 4, a host controller 5, a vector controller 6, a carrier frequency switch circuit 8, a current detector 11, an encoder 12, a traction sheave 21, an elevator cage 22, a counter weight 23 and a load sensor 24. Herein, the elevator cage 22 is controlled so as to be located at a target position through the AC motor 3.

The power converter 2 has a function of performing PWM control based on a voltage command and a carrier frequency signal in order to drive the elevator cage 22 and supplying an AC power to the AC motor 3. More specifically, the power converter 2 generates a direct-current (DC) voltage by converting an AC voltage from the AC power supply 1 into the DC voltage by rectification, and performs PWM control by use of a base signal based on a voltage command from the base drive circuit 4. Then, the power converter 2 subjects a plurality of switching elements incorporated therein to base drive, and drives the AC motor 3 by voltage application.

The base drive circuit 4 outputs a base signal to the power converter 2 in accordance with a voltage command (V) from the vector controller 6 and a carrier frequency signal, e.g., a triangular-wave carrier frequency signal (an Fc signal) from the carrier frequency switch circuit 8.

The traction sheave 21 is coupled to the AC motor 3, and each of the elevator cage 22 and the counter weight 23 is suspended by the traction sheave 21. Herein, the elevator cage 22 may include a load sensor 24 if necessary. The load sensor 24 detects a load onto the elevator cage 22, and sends a load signal indicating an amount of the detected load to the host controller 5.

The host controller 5 acquires a target position from destination floor information to be input thereto, converts the target position into a speed command $\omega r^*$ by use of information such as a position signal $\theta$ from the encoder 12, a preset acceleration/deceleration rate, and a diameter of the traction sheave 21, and outputs the speed command $\omega r^*$. Further, the host controller 5 also outputs an activation torque compensation Tload, based on a load signal from the load sensor 24.

The carrier frequency switch circuit 8 sets a carrier frequency signal (an Fc signal) and a torque limit value Tlim, based on a torque command Tref to be input thereto. The carrier frequency switch circuit 8 sends the carrier frequency signal (the Fc signal) to the base drive circuit 4, and also sends the torque limit value Tlim to the vector controller 6. The process of setting the respective values will be described later.

The current detector 11 detects as a current signal (I) a three-phase current (iu, iv, iw) which flows through the AC motor 3.

The encoder 12 is connected to the AC motor 3 to detect a position signal θ of the AC motor 3.

Figure 2:
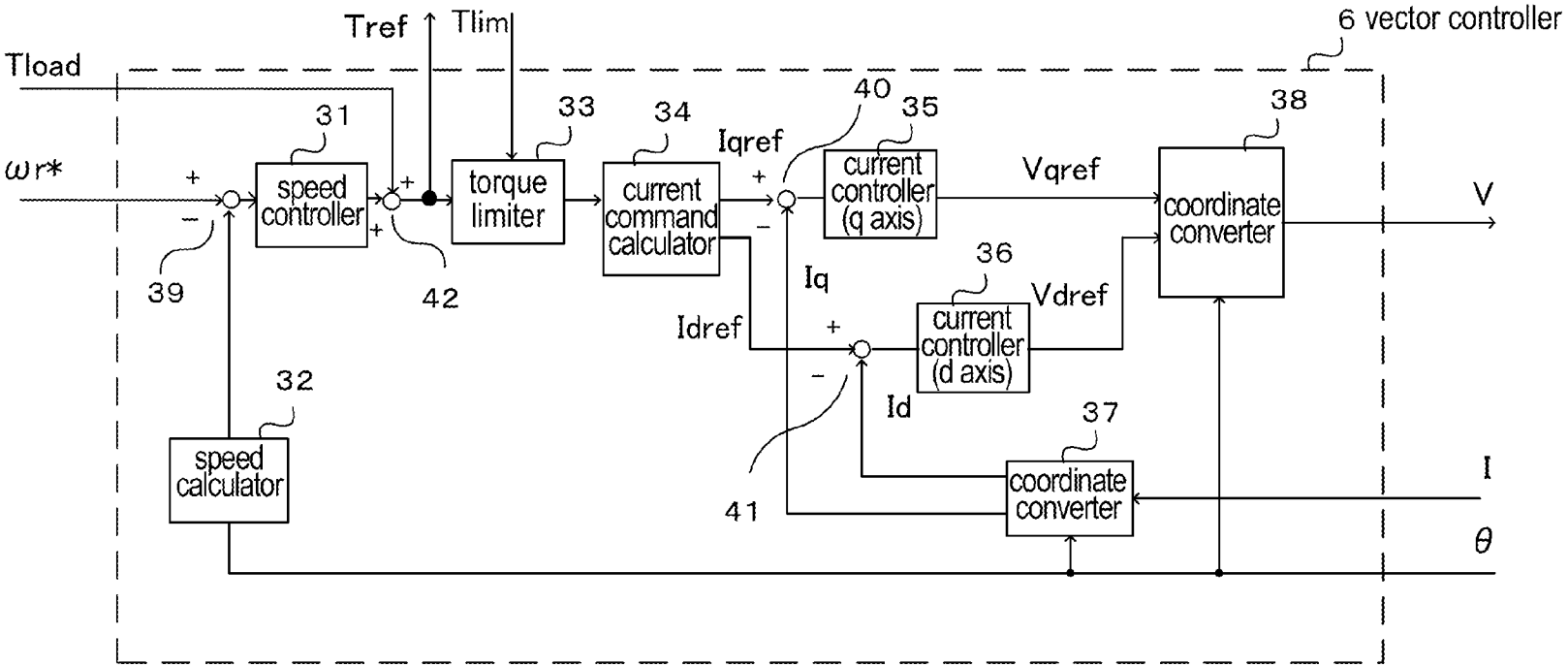
FIG. 2 shows a block diagram of details of a vector controller according to the first embodiment.

FIG. 2 shows a block diagram of details of the vector controller 6. The vector controller 6 has a function of calculating and outputting a voltage command (V) required for driving the elevator cage 22 through the AC motor 3, in a process to be described later.

The vector controller 6 is a motor controller that includes a speed controller 31, a speed calculator 32, a torque limiter 33, a current command calculator 34, a current controller (q axis) 35, a current controller (d axis) 36, a coordinate converter 37, a coordinate converter 38, subtracters 39 to 41, and an adder 42.

The speed controller 31 controls a difference between a speed command ωr* calculated by the subtracter 39 and a speed detection signal ωr to be described later (a speed deviation Δωr) such that the speed deviation Δωr takes a value of zero. The adder 42 adds an output from the speed controller 31 and an activation torque compensation Tload to prepare a torque command Tref, and outputs the torque command Tref to each of the torque limiter 33 and the carrier frequency switch circuit 8.

The speed calculator 32 calculates as a speed detection signal ωr an amount of change in an output signal from the encoder 12 per unit time.

The torque limiter 33 limits a torque command Tref by use of a smaller one of a preset torque limit value and a torque limit value Tlim from the carrier frequency switch circuit 8. The torque limiter 33 outputs the torque command Tref thus limited to the current command calculator 34. The AC motor 3 is driven by this torque command Tref.

The current command calculator 34 calculates a current command (Idref, Iqref) by use of a torque command Tref to be input thereto.

The current controller (q axis) 35 controls a difference between a current command Iqref calculated by the subtracter 40 and an electric current Iq to be described later (a current deviation Δiq) such that the current deviation ΔIq takes a value of zero, thereby calculating a voltage command Vqref.

Likewise, the current controller (d axis) 36 controls a difference between a current command Idref calculated by the subtracter 41 and an electric current Id to be described later (a current deviation ΔId) such that the current deviation ΔId takes a value of zero, thereby calculating a voltage command Vdref.

The coordinate converter 37 converts a current signal (I) into a two-phase current (Id, Iq) on a rotational coordinate system. The coordinate converter 38 converts a voltage command (Vdref, Vqref) into a three-phase voltage command (Vu*, Vv*, Vw*), and outputs this three-phase voltage command as a voltage command (V).

Thus, the vector controller 6 receives a speed command ωr* from the host controller 5, a torque limit value Tlim from the carrier frequency switch circuit 8, a current signal (I) from the current detector 10, and a position signal θ from the encoder 12, subjects these inputs to vector control, and outputs a voltage command (V).

Figure 3A:
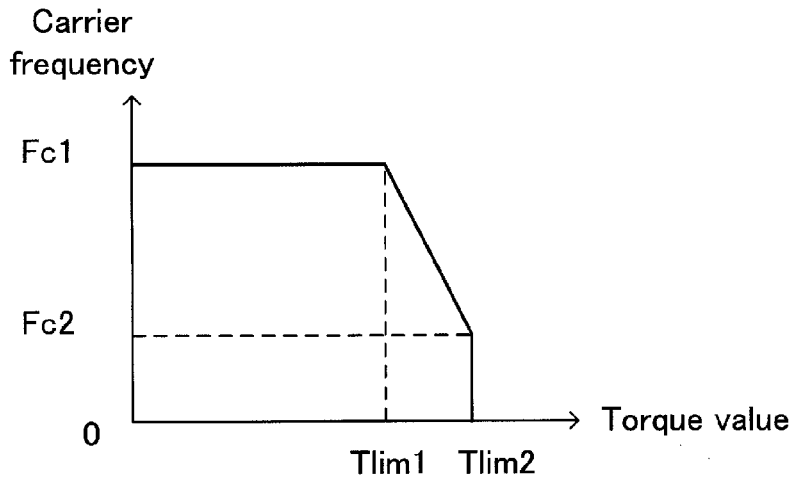
FIG. 3A shows a graph of a relation between a torque and an allowable carrier frequency.

Next, the carrier frequency switch circuit 8 is described. The carrier frequency switch circuit 8 has a function of outputting a carrier frequency signal (an Fc signal) in accordance with a torque command Tref for driving the AC motor 3. FIG. 3A shows a graph of a relation between a torque and an allowable carrier frequency in the first embodiment. The carrier frequency switch circuit 8 changes a carrier frequency signal (an Fc signal) when a torque command Tref reaches a torque value (a torque limit value) shown in FIG. 3A.

In FIG. 3A, carrier frequencies Fc1 and Fc2 as well as limit torques Tlim1 and Tlim2 are set for protection of the switching elements that form the power converter 2. A user is incapable of setting and changing these values. Normally, the relation shown in FIG. 3A is established based on a degree of loss to be caused to a switching element. As long as the power converter 2 is used within the range defined with the carrier frequency and the limit torque, a damage to be caused to the switching element becomes allowable.

When the carrier frequencies Fc1 and Fc2 are set at a maximum value and a minimum value of a carrier frequency F which can be set by the user, respectively, an elevator is operated within this range even in a status other than an overload status. For example, the carrier frequency Fc1 is set at a value of 15 kHz, the limit torque Tlim1 takes a value of (150%×inverter rated torque), the carrier frequency Fc2 takes a value of 2 kHz, and the limit torque Tlim2 takes a value of (190%×inverter rated torque); however, the present invention is not limited to these values. Herein, a torque generated from the AC motor 3, through which an electric current corresponding to a rated current of an inverter device flows, is defined as a rated torque (100%). The inverter rated torque is set by use of the rated current of the inverter device, a motor constant of the AC motor 3, and the like.

Prior to operation of the elevator, the user sets the carrier frequency F and the torque limit value Tlim of the elevator control device I.

During operation of the elevator, the carrier frequency switch circuit 8 receives a torque command Tref calculated by the speed controller 31. When a value of a carrier frequency set at this time is in the range shown in FIG. 3A, the carrier frequency switch circuit 8 sends an Fc signal which is equal in value to a preceding Fc signal to the base drive circuit 4, and also sends a torque limit value Tlim which is equal in value to a preceding torque limit value Tlim to the torque limiter 33. When the value is out of the range, the carrier frequency switch circuit 8 sends an Fc signal taking a maximum value which is allowable at this time, i.e., a limit value plotted on the graph shown in FIG. 3A to the base drive circuit 4. Moreover, the carrier frequency switch circuit 8 also sends a torque limit value Tlim taking a maximum value which is allowable at this time, i.e., a limit value plotted on the graph shown in FIG. 3A to the torque limiter 33.

Thus, the carrier frequency switch circuit 8 controls the relation between the torque command Tref to be input thereto and the carrier frequency Fc such that this relation falls within the range shown in FIG. 3A. In a case where there is no set resolution of the carrier frequency Fc, the carrier frequency signal may be quantized so as to fall within the range.

As described above, the carrier frequency switch circuit 8 outputs the carrier frequency signal (the Fc signal) and the torque limit value Tlim in accordance with the torque command Tref. Therefore, the carrier frequency Fc automatically decreases as the torque command Tref increases.

In the foregoing description, the increase of the torque limit value is necessary because the decrease of the carrier frequency Fc allows enhancement of the protection level for the switching element that forms the power converter 2. Alternatively, the protection of the switching element may be exerted with flexibility in such a manner that the carrier frequency Fc is changed, but the torque limit value Tlim is fixed.

The elevator control device I according to the first embodiment of the present invention can automatically decrease a carrier frequency such that a torque command for driving an AC motor falls within an allowable range, and can continuously operate an elevator without causing damage to a switching element.

Figure 4:
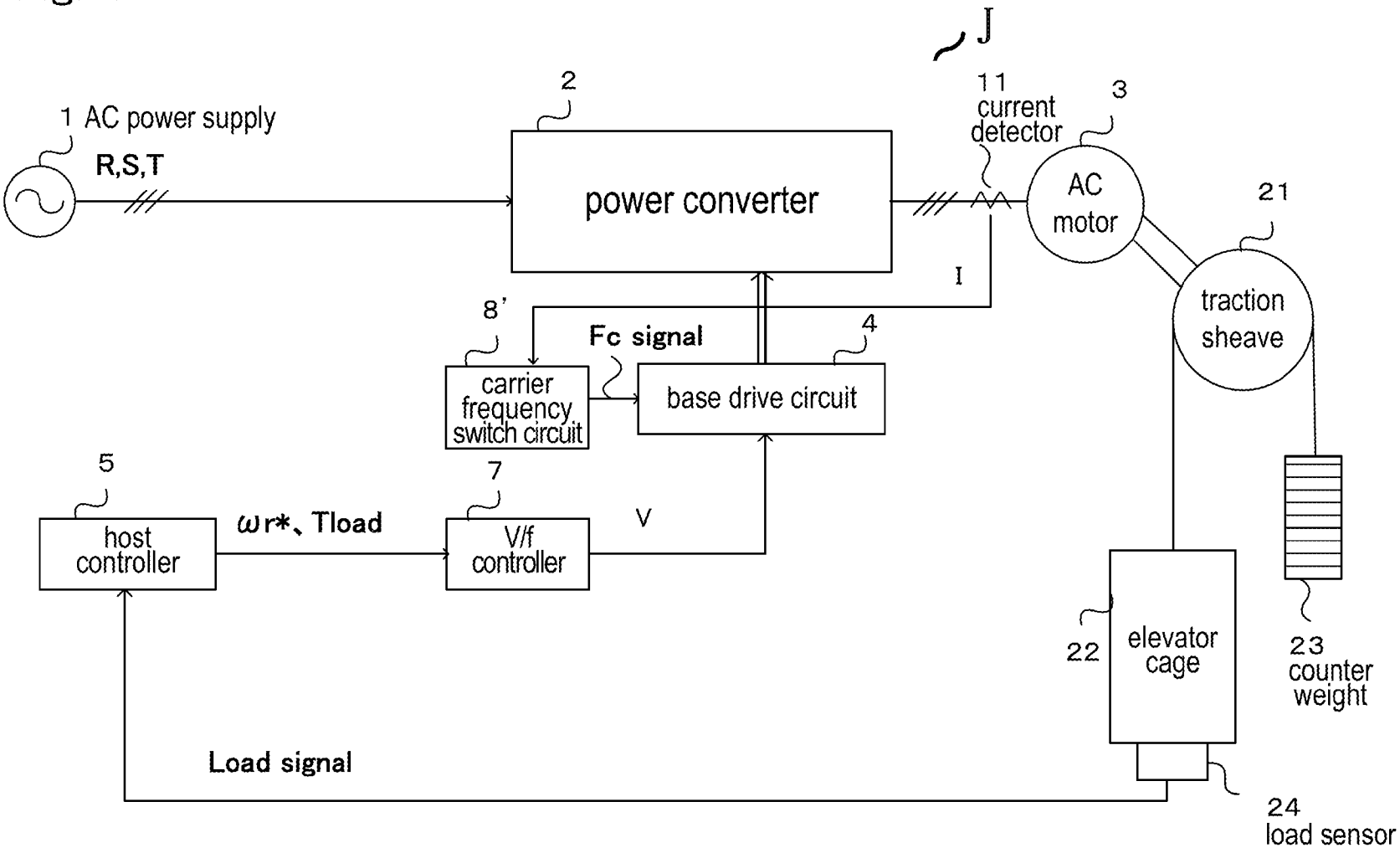
FIG. 4 shows a block diagram of a configuration of an elevator control device J according to a second embodiment of the present invention.

FIG. 4 shows a block diagram of an elevator control device J according to a second embodiment of the present invention. In the first embodiment, the elevator control device I employs the vector controller 6 as a motor controller. In the second embodiment, on the other hand, the elevator control device J employs a V/f controller 7. Further, the elevator control device J includes a carrier frequency switch circuit 8' in place of the carrier frequency switch circuit 8. In the elevator control device J, elements other than those mentioned above are designated using the same reference numerals as those described in the foregoing embodiment; therefore, detailed description thereof will not be given here.

The V/f controller 7 has a function of controlling an output voltage such that the output voltage rises almost in proportional to a frequency, i.e., controlling the output voltage such that a voltage-to-frequency ratio becomes fixed (V/f=a fixed value), and calculating and outputting a voltage command (V) required for driving an elevator cage 22 through an AC motor 3. This voltage command (V) is obtained by coordinate conversion of a voltage command Vqref which is almost proportional to a frequency command and a voltage command Vdref which takes a value of zero. An expression for calculation of the voltage command (V) is publicly known; therefore, description thereof will not be given here.

Figure 3B:
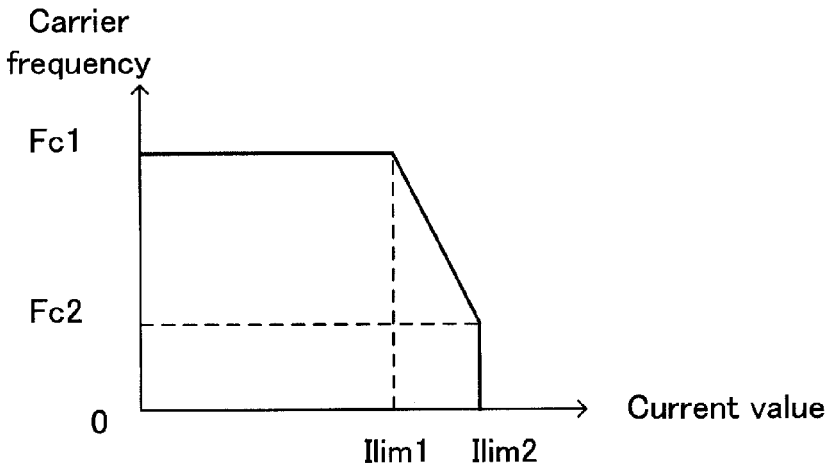
FIG. 3B shows a graph of a relation between an output current and an allowable carrier frequency.

Next, specific operations of the carrier frequency switch circuit 8' are described. The carrier frequency switch circuit 8' has a function of outputting a carrier frequency signal (an Fc signal) in accordance with an electric current which flows through the AC motor 3, i.e., an output current from a power converter 2. FIG. 3B shows a graph of a relation between an output current and an allowable carrier frequency in the second embodiment. The carrier frequency switch circuit 8' changes a carrier frequency signal (an Fc signal) when an output current reaches a current value (a limit current value) shown in FIG. 3B.

In FIG. 3B, carrier frequencies Fc1 and Fc2 as well as limit current values Ilim1 and Ilim2 for an inverter output current are set for protection of switching elements that form the power converter 2. A user is incapable of setting and changing these values. Normally, the relation shown in FIG. 3B is established based on a degree of loss to be caused to the switching element. As long as the power converter 2 is used within the range defined with the carrier frequency and the limit current value, a damage to be caused to the switching element becomes allowable. For example, the carrier frequency Fc1 is set at a value of 15 kHz, the limit current value Ilim1 takes a value of (150%×inverter rated current), the carrier frequency Fc2 takes a value of 2 kHz, and the limit current value Ilim2 takes a value of (190%×inverter rated current); however, the present invention is not limited to these values.

Prior to operation of the elevator, the user sets the carrier frequency F of the elevator control device J.

During operation of the elevator, the carrier frequency switch circuit 8' receives a current signal (I) detected by a current detector 11 and calculates a magnitude of the current signal (I) as an inverter output current Iout. When the carrier frequency F set at this time is in the range shown in FIG. 3B, the carrier frequency switch circuit 8' sends an Fc signal which is equal in value to a preceding Fc signal to a base drive circuit 4. When the carrier frequency F is out of the range, the carrier frequency switch circuit 8' sends an Fc signal taking a maximum value which is allowable at this time, i.e., a value plotted on the graph shown in FIG. 3B to the base drive circuit 4.

Thus, the carrier frequency switch circuit 8' controls the relation between the carrier frequency Fc and the inverter output current Iout such that this relation falls within the range which is determined by an allowable function and is shown in FIG. 3B. In a case where there is no set resolution of the carrier frequency Fc, the carrier frequency signal may be quantized so as to fall within the range.

As described above, the carrier frequency switch circuit 8' outputs the carrier frequency signal (the Fc signal) in accordance with the inverter output current Iout. Therefore, the carrier frequency Fc automatically decreases as the inverter output current Iout increases.

In the foregoing description, the increase of the limit current value is necessary because the decrease of the carrier frequency Fc allows enhancement of the protection level for the switching element that forms the power converter 2. Alternatively, the protection of the switching element may be exerted with flexibility in such a manner that the carrier frequency Fc is changed, but the limit current value Ilim is fixed.

Although not shown in FIG. 4, occasionally, the V/f controller 7 has a stalling prevention function of suppressing the inverter output current Iout. In such a case, a stalling level in the stalling prevention function may be changed by reference of a limit current value Ilim set by the carrier frequency switch circuit 8', as in the first embodiment in which the vector controller 6 changes a torque limit value Tlim.

The elevator control device J according to the second embodiment of the present invention can automatically decrease a carrier frequency in an overload state even when a motor controller thereof is a V/f controller, and can continuously operate an elevator without causing damage to a switching element.

Figure 5:
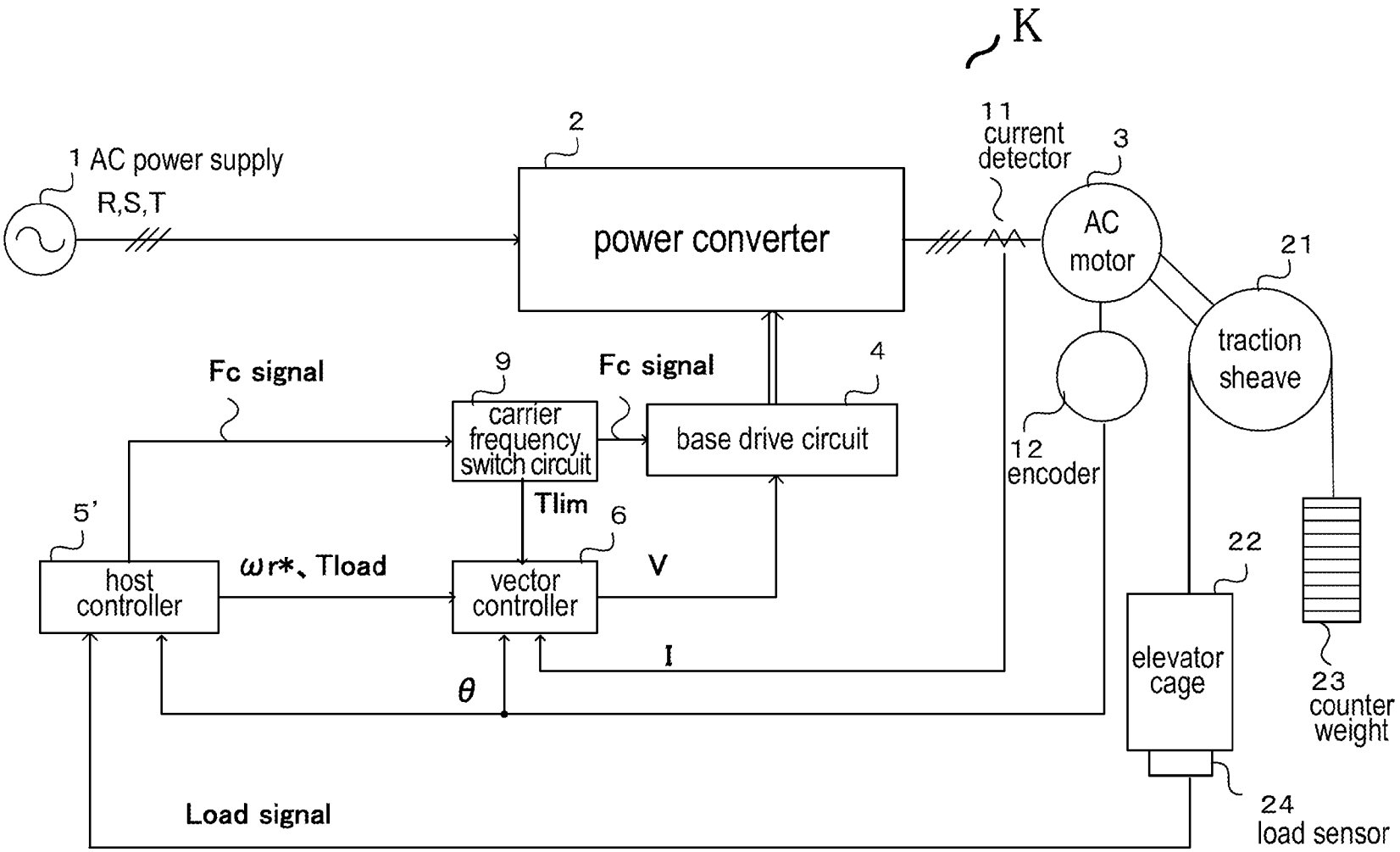
FIG. 5 shows a block diagram of a configuration of an elevator control device K according to a third embodiment of the present invention.

FIG. 5 shows a block diagram of a configuration of an elevator control device K according to a third embodiment of the present invention. As compared with the elevator control device I, the elevator control device K includes a host controller 5' in place of the host controller 5, and a carrier frequency switch circuit 9 in place of the carrier frequency switch circuit 8. In the elevator control device K, elements other than those mentioned above are designated using the same reference numerals as those described in the foregoing embodiments; therefore, detailed description thereof will not be given here.

The third embodiment is based on the following considerations. In an elevator, typically, an acceleration/deceleration rate becomes fixed without changing when being set once upon test operation, a load does not change during operation, and a torque becomes maximum upon acceleration/deceleration. In view of these facts, it is possible to grasp a timing that a torque command Tref reaches a torque limit value during operation of an elevator, based on a superimposed load upon start of the operation.

Figure 6:
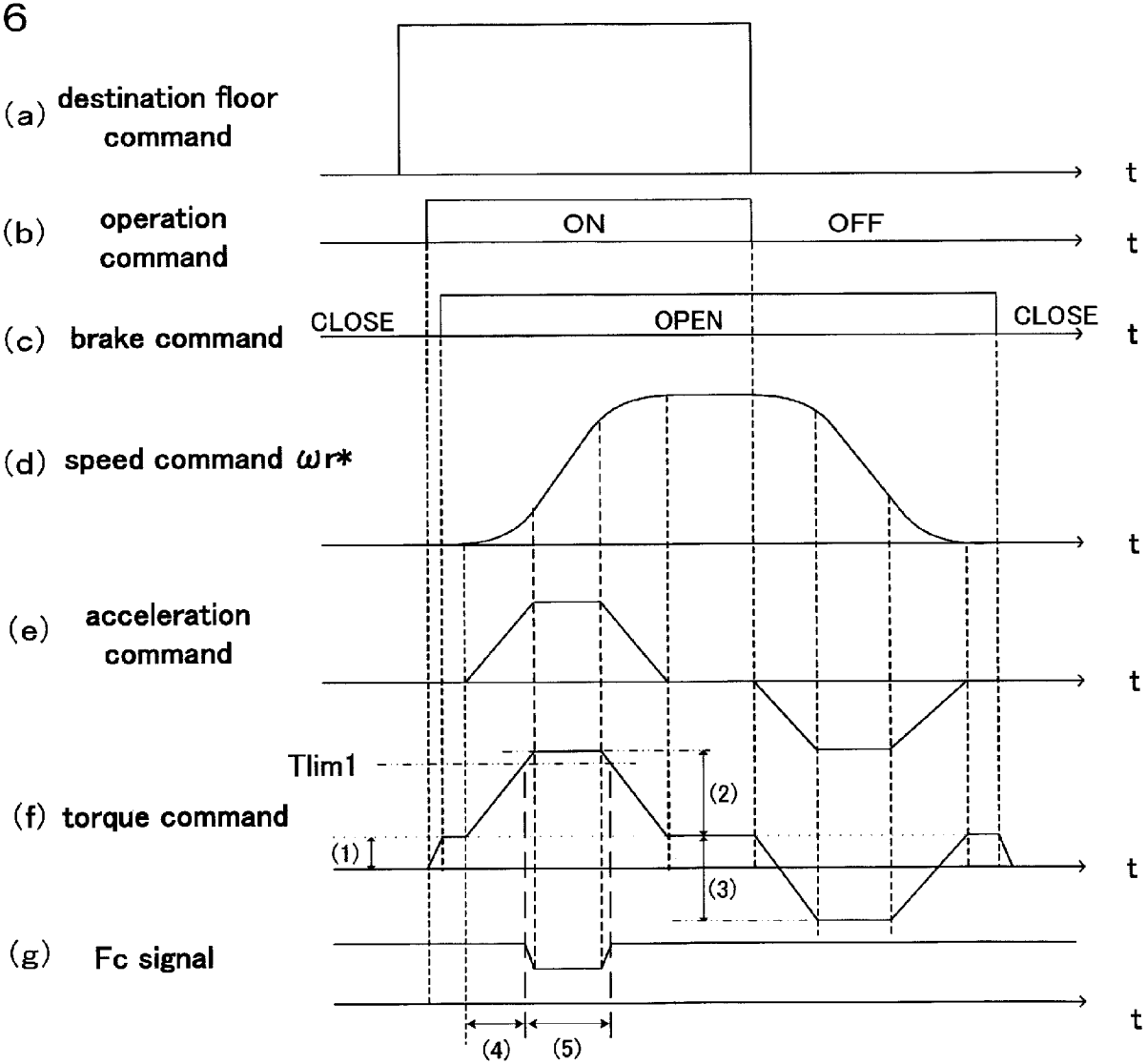
FIG. 6 shows a timing chart of change in a torque command during operation of an elevator.

The host controller 5' stores therein the relation between the torque and the allowable carrier frequency shown in FIG. 3A. The host controller 5' has a function of predicting and calculating a torque command Tref for an AC motor 3 upon acceleration and predicting a timing that the torque command Tref reaches the torque value (the torque limit value) shown in FIG. 3A, prior to operation of an elevator. The torque command Tref to be predicted and calculated by the host controller 5' upon acceleration is described with reference to FIG. 6. FIG. 6 shows a timing chart of change of the torque command Tref in conjunction with signals to be described below, in a case where the elevator moves upward.

Specifically, FIG. 6 shows a destination floor command (a), an operation command (b), a brake command (c), a speed command ωr* (d), an acceleration command (e), a torque command Tref (f), and an Fc signal (g).

Although not shown in FIG. 5, the host controller 5' receives a destination floor command from an indicator of an elevator cage 22, and then sets a command for a target position. Thereafter, a door of the elevator is closed, and the operation command (b) is activated for operating the elevator. Herein, an activation torque compensation Tload is calculated based on a load signal from a load sensor 24, and is output to a vector controller 6. In the torque command Tref (f), a portion (1) corresponds to a value of the activation torque compensation Tload.

Next, when the torque command Tref reaches the value of the activation torque compensation Tload, the elevator is subjected to speed control. Then, the brake command (c) is output for releasing a brake, so that the speed command ωr* (d) gradually increases from a value of zero in accordance with an acceleration rate including a set S-shaped curve. Thus, the torque command Tref (f) increases, and then decreases as the acceleration rate becomes gentle. Herein, a section (5) due to a limit torque is generated at the torque command Tref, depending on a load onto the elevator cage 22 and a set value of the acceleration rate.

When the speed command ωr* becomes fixed, the torque command Tref takes only a value obtained from the load onto the elevator cage 22. As the elevator is gradually decelerated, the torque command Tref approaches the value of zero. In some statuses, the torque command Tref takes a negative value, and further, a section due to a limit torque is generated at the torque command Tref although not shown in FIG. 6.

When the elevator cage 22 reaches the target position and the speed command ωr* takes the value of zero, the brake command (c) is output for applying a brake. Thus, the speed control is completed. The respective signals vary as described above during operation of the elevator.

In the foregoing description, the speed command ωr* output from the host controller 5' varies in accordance with the acceleration rate including the set S-shaped curve. Alternatively, the speed command ωr* may be calculated in such a manner that the acceleration command (e) is set first and then a value thereof is subjected to integration.

It is apparent from the timing chart in FIG. 6 that the acceleration command is set when the destination floor is selected. Further, the torque command Tref during operation is calculated in such a manner that the activation torque compensation Tload is added to the acceleration command based on the load signal from the load sensor 24. Upon acceleration and deceleration, the magnitude of the torque command Tref shifts upward by an amount of the activation torque compensation Tload (corresponding to the portion (1)) (in FIG. 6, portions (2) and (3) are identical in magnitude to each other).

Accordingly, when a destination floor and a load signal upon start of operation are set, it is possible to determine a timing that a torque command Tref reaches a torque limit value Tlim1.

At the timing that the torque command Tref reaches the torque limit value Tlim1, the carrier frequency decreases from a value of Fc1, so that the limit torque increases. In actual operation, therefore, the elevator is subjected to no torque limitation.

A timing that a value obtained by addition of a load signal upon start of operation to an acceleration command set based on a destination floor becomes larger than a limit torque is stored as a time corresponding to a portion (4) in FIG. 6 with respect to a point that a speed command ωr* increases from a value of zero or a point that an elevator is decelerated. Thus, it is possible to grasp a timing that a torque command Tref reaches a torque limit value. In the Fc signal (g), moreover, since a time required to reach a maximum torque, a value of the maximum torque and an allowable carrier frequency at this time can be grasped previously, a portion corresponding to an inclination of change may be set by use of these values.

As described above, the host controller 5' can previously set the carrier frequency, based on the timing of change of the speed command ωr*. Therefore, the host controller 5' can previously grasp the timing of overload, so that the elevator can be operated without such an overload status.

During operation of the elevator, moreover, the host controller 5' sends the carrier frequency signal (the Fc signal), which is set as described above, to the carrier frequency switch circuit 9. The carrier frequency switch circuit 9 calculates the torque limit value Tlim in accordance with the value of the Fc signal and the relation shown in FIG. 3A, and outputs the torque limit value Tlim to the vector controller 6.

In the foregoing description, the torque command Tref is set by use of the value obtained by adding the load signal upon start of operation to the acceleration command set based on the destination floor. Alternatively, the torque command Tref can be set more accurately in such a manner that a mechanical efficiency of the elevator is measured previously and then is added to an acceleration command for reference.

Moreover, the process to be carried out prior to operation of the elevator needs to be carried out each time the output from the load sensor 24 varies. For this reason, it is convenient that this process is carried out after the door of the elevator is closed.

Further, the host controller 5' can previously grasp the fact that the torque command Tref reaches the torque limit value even when the carrier frequency switch circuit 9 changes the carrier frequency Fc within an allowable range. In such a case, an interlock is actuated, e.g., a buzzer attached to the elevator cage 22 is pressed, for stopping the operation of the elevator. Thus, it is possible to provide a safe inverter device for elevators.

In the foregoing description, the vector controller 6 is employed as a motor controller. In the case of the elevator control device J that employs the V/f controller 7, the host controller may store therein the relation between the output current and the allowable carrier frequency shown in FIG. 3B and have the function of predicting the timing that the output current Iout reaches the current value (the limit current value) shown in FIG. 3B prior to operation of the elevator, and the carrier frequency switch circuit may change the carrier frequency at the predicted timing.

The elevator control device K according to the third embodiment of the present invention can previously predict a fact that a torque command Tref reaches a torque limit value, and further, can automatically decrease a carrier frequency such that the torque command falls within an allowable range.

As described above, according to the foregoing embodiments, it is possible to automatically decrease a carrier frequency only in a required case in accordance with an operation status. As a result, it is possible to keep a good balance between such a request to use an elevator control device in a low-noise environment and such a request to ensure a current capacity of an inverter device.

Figure 7:
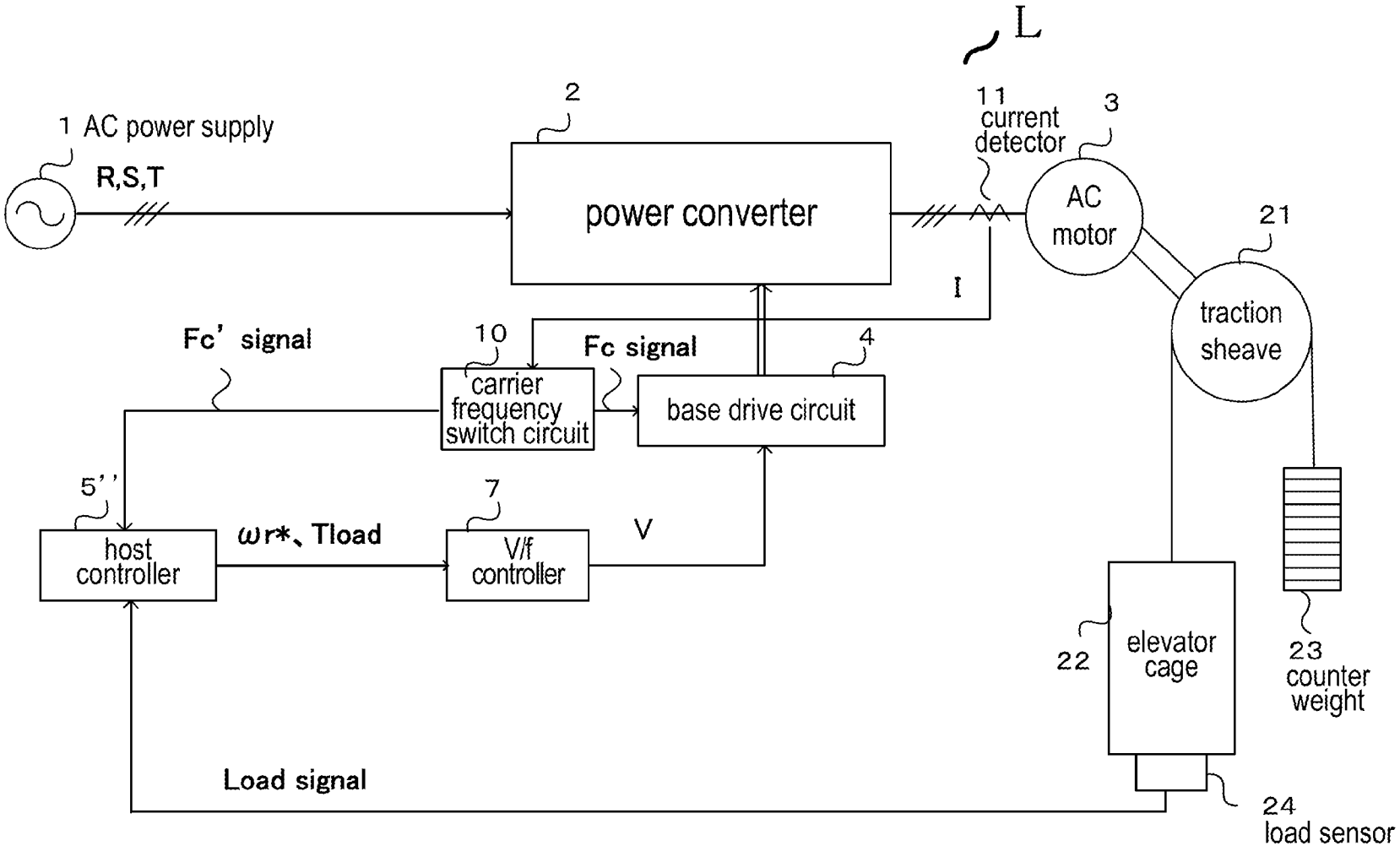
FIG. 7 shows a block diagram of a configuration of an elevator control device L according to a fourth embodiment of the present invention.

FIG. 7 shows a block diagram of a configuration of an elevator control device L according to a fourth embodiment of the present invention. As compared with the elevator control device J, the elevator control device L includes a host controller 5" in place of the host controller 5, and a carrier frequency switch circuit 10 in place of the carrier frequency switch circuit 8'. Herein, the elevator control device L employs a vector controller 6 as a motor controller. In the elevator control device L, elements other than those mentioned above are designated using the same reference numerals as those described in the foregoing embodiments; therefore, detailed description thereof will not be given here.

The carrier frequency switch circuit 10 operates as in the carrier frequency switch circuit 8' of the elevator control device J. Thus, the carrier frequency switch circuit 10 changes a carrier frequency signal (an Fc signal) when an output current reaches the current value (the limit current value) shown in FIG. 3B during operation of an elevator, and sends the Fc signal to each of a base drive circuit 4 and the host controller 5".

The host controller 5" stores therein the relation between the torque and the allowable carrier frequency shown in FIG. 3A. The host controller 5" operates as in the host controller 5' of the elevator control device K. Thus, the host controller 5" predicts a torque command upon acceleration by use of a superimposed load onto an elevator cage, and predicts a timing that the torque command reaches a torque limit value, as a timing of change of an Fc' signal, prior to operation of the elevator.

The host controller 5" can monitor data obtained by comparison between the Fc signal from the carrier frequency switch circuit 10 and the Fc' signal calculated previously by the host controller 5" itself. Examples of a difference to be compared herein include a difference of occasions of overload, and a difference of a timing of overload. The host controller 5" monitors these differences to grasp secular change of the elevator control device L.

The host controller 5" may display an overload status or send the overload status to a different device. This overload status can be utilized as abnormal data about the elevator control device L.

In a case where a load status of the elevator does not change, the host controller 5" may count only the Fc' signal from the carrier frequency switch circuit 10, and then may display or send the Fc' signal.

The elevator control device L according to the fourth embodiment of the present invention can grasp an abnormal state thereof. This configuration is effective at maintenance such as a periodic inspection.

The present invention is not limited to the foregoing embodiments, and may be modified appropriately. For example, a different type of compensation using a carrier frequency may be performed in such a manner that an Fc signal to be set by the carrier frequency switch circuit 8 or 8' is sent to the host controller 5. In the foregoing embodiments, the load onto the elevator cage is detected by the load sensor. Alternatively, such a load may be obtained from a torque command value in a case where the elevator is operated at zero speed, and others. In the example of vector control of the inverter device, further, the encoder is used. Alternatively, the speed and the position information may be obtained by use of a magnetic flux observer or the like.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. An elevator control device comprising:

an AC motor;

a motor controller configured to calculate a voltage command required for driving an elevator cage through the AC motor;

a carrier frequency switch circuit configured to output a carrier frequency and a torque limit value corresponding to the carrier frequency based on an input torque command, the carrier frequency switch circuit being configured to store a relation between the torque limit value and an allowable carrier frequency, the relation including an allowable range of the torque limit value and the carrier frequency, the carrier frequency switch circuit outputting the torque limit value and the carrier frequency which are within the allowable range if the input torque command is out of the allowable range;

a torque limiter configured to limit the input torque command to a smaller one of a preset torque limit value and the torque limit value output from the carrier frequency switch circuit; and a power converter configured to perform PWM control based on the voltage command and the carrier frequency which is output from the carrier frequency switch circuit and configured to supply an AC power to the AC motor.

2. An elevator control device comprising:

an AC motor;

a motor controller that calculates a voltage command required for driving an elevator cage through the AC motor;

a carrier frequency switch circuit that outputs a carrier frequency signal;

a power converter that performs PWM control based on the voltage command and the carrier frequency signal and supplies an AC power to the AC motor; and a host controller that predicts and calculates the torque command upon acceleration, wherein the carrier frequency switch circuit changes the carrier frequency signal such that one of a torque command for driving the AC motor and an output current from the power converter falls within a limited range, the motor controller is one of a vector controller and a V/f controller, the host controller predicts one of a timing that the torque command reaches a torque limit value and a timing that the output current reaches a limit current value, prior to operation of an elevator, and the carrier frequency switch circuit changes the carrier frequency signal at one of the predicted timings.

3. The elevator control device according to claim 2, wherein the carrier frequency switch circuit sets the carrier frequency signal in accordance with one of a relation between a torque and an allowable carrier frequency and a relation between an output current and the allowable carrier frequency.

4. The elevator control device according to claim 2, wherein the motor controller is a vector controller, the host controller predicts the timing that the torque command reaches the torque limit value, based on a superimposed load onto the elevator cage and the torque command, prior to operation of the elevator, the carrier frequency switch circuit changes the carrier frequency signal when the output current from the power converter reaches the limit current value during operation of the elevator, and the host controller monitors data about comparison between the predicted timing and the timing of change.

5. The elevator control device according to claim 4, wherein the comparison data contains at least a difference of occasions of decreasing the carrier frequency signal, and a deviation time of the timing of change.

6. An elevator control device comprising:

an AC motor;

a motor controller configured to calculate a voltage command required for driving an elevator cage through the AC motor;

a power converter configured to perform PWM control based on the voltage command and a carrier frequency and configured to supply an AC power to the AC motor; and a carrier frequency switch circuit configured to output the carrier frequency based on an output current of the power converter and configured to store a relation between the output current and an allowable carrier frequency, the relation including an allowable range of the output current and the carrier frequency, the carrier frequency switch circuit outputting the carrier frequency which is within the allowable range if the output current is out of the allowable range.

* * * * *